United States Patent [19]

Mitsuhashi et al.

[11] Patent Number: 4,565,766

[45] **Date of Patent: * Jan. 21, 1986**

[54] DEVELOPING POWDER

[75] Inventors: Yasuo Mitsuhashi, Yokohama; Masaki Uchiyama, Tokyo, both of Japan

[73] Assignee: Canon Kabushiki Kaisha, Tokyo, Japan

[ * ] Notice: The portion of the term of this patent subsequent to Nov. 6, 2001 has been disclaimed.

[21] Appl. No.: 620,807

[22] Filed: Jul. 20, 1984

Related U.S. Application Data

[63] Continuation of Ser. No. 319,083, Nov. 6, 1981, Pat. No. 4,481,274.

[30] Foreign Application Priority Data

Nov. 11, 1980 [JP] Japan ..... 55-158511

[51] Int. Cl.[4] ..... G03G 15/16

[52] U.S. Cl. ..... 430/126; 430/122

[58] Field of Search ..... 430/106.6, 122, 126

[56] References Cited

U.S. PATENT DOCUMENTS

| | | | |
|---|---|---|---|
| 2,221,776 | 11/1940 | Carlson | 430/48 |
| 2,297,691 | 10/1942 | Carlson | 430/55 |
| 2,874,063 | 2/1959 | Greig | 117/17.5 |
| 3,666,363 | 5/1972 | Tanaka et al. | 355/17 |
| 3,839,029 | 10/1974 | Berg et al. | 430/120 |
| 3,909,258 | 9/1975 | Kotz | 430/122 |
| 3,941,898 | 3/1976 | Sadamatsu et al. | 430/121 |
| 4,071,361 | 1/1978 | Marushima | 430/34 |
| 4,265,992 | 5/1981 | Kouchi et al. | 430/106.6 |
| 4,340,660 | 7/1982 | Kiuchi et al. | 430/106 |
| 4,350,440 | 9/1982 | Watanabe | 430/122 |
| 4,374,191 | 2/1983 | Mukoh et al. | 430/122 |

*Primary Examiner*—John L. Goodrow

*Attorney, Agent, or Firm*—Fitzpatrick, Cella, Harper & Scinto

[57] ABSTRACT

A developing powder comprises a binder containing 50% by weight or more of a polymer having a gel content of 10% or less and prepared from a vinyl type monomer and a crosslinking agent monomer contained in an amount of 0.01–10% by weight based on the total weight of the monomers, and 0.1–5% by weight of an olefin homopolymer or copolymer having a melt viscosity at 140° C. of 10–$10^6$ cps.

1 Claim, 1 Drawing Figure

DEVELOPING POWDER

This is a continuation of application Ser. No. 319.083, filed Nov. 6, 1981, now U.S. Pat. No. 4,481,274.

BACKGROUND OF THE INVENTION

1. Field of the Invention

This invention relates to a developing powder used for electrophotographic methods, electrostatic recording methods, magnetic recording methods, and the like.

2. Description of the Prior Art

Heretofore, various electrophotographic methods have been known, for example, those as disclosed in U.S. Pat. Nos. 2,297,691, 3,666,363, 4,071,361 and the like. In general, electrophotographic methods comprise utilizing a photoconductive material, forming electric latent images on a photosensitive member by various means, developing the resulting latent images with a developing powder (hereinafter referred to as "toner"), if desired, transferring the toner images to a receiving member such as paper, and then fixing the toner images by heat, pressure or a solvent vapour to produce a copy. Where there is a step of transferring toner images, there is usually provided a step of removing the remaining toner on the photosensitive member.

A wide variety of techniques are known for visualizing electric latent images with a toner such as magnetic brush (e.g. U.S. Pat. No. 2,874,063), cascading developing (e.g. U.S. Pat. No. 2,618,552), powder cloud method (e.g. U.S. Pat. No. 2,221,776), conductive magnetic toner method (e.g. U.S Pat. No. 3,909,258) and the like.

As the toners suitable for these developing methods, there have been used finely divided particles of natural or synthetic resins in which dye or pigment is dispersed. For example, finely divided particles of 1–30$\mu$ in size of a resinous binder such as polystyrene and the like containing a dispersed colorant can be mentioned. As the magnetic toner, a toner containing particles of a magnetic material such as magnetite is used. As a so-called two-component developing agent, the toner is usually used together with carrier particles such as glass beads, iron powders and the like. These toners are required to have various physical or chemical characteristics, but most of prior art toners suffer from some of the following drawbacks.

Most of the toners which easily melt by heat often cake or coagulate during storage or in copying machines. Most of toners are deteriorated with respect to triboelectric property and flowability depending upon the ambient temperature change. Further, when toner particles and carrier particles are continuously used for repeated copying, these particles collide each other and contact the surface of the photosensitive plate resulting in mutual degradation of the toners, carrier particles and photosensitive plate. Thus, the resulting image density changes and are not uniform, the fog density increases or quality of the copy is lowered. Moreover, in the case of most of toners, when the amount of toner attached to a photosensitive plate bearing latent images is increased so as to enhance the developed image density, the fog density usually increases.

Among those undesirable phonomena, there is included a phenomenon which occurs due to brittleness of the toner particles, that is, a phenomenon concerning the life of the developer. In the developing vessel the toner particles are brought in contact with the latent images and during said process the toner particles are subjected to load by blades, transferring system, other toner particles, carrier particles and the like. Toner particles are crashed by this load, and adhere to carrier particles and remain in the developing vessel resulting in deterioration of the developer. In order to avoid such deterioration, polymers of high molecular weight may be used, but the fixation temperature is elevated upon thermal fixation and this disadvantageously results in a large consumption of thermal energy.

Furthermore, in order to eliminate the above metnioned drawback, it is proposed to add a small amount of a plasticizer to the toner, but such addition adversely affects the free flowability of the toner and causes contamination of carriers, and this proposal can not successfully solve the problem.

These problems are common to both one-component development and two-component development. In general, one-component developing system is more advantageous than two-component developing system, but one-component developing system has its inherent disadvantages. That is, in the developing process using a one-component magnetic toner, the toner particles do not move about on the toner holding member to a great extent because the agitation operation is so little. Therefore, when a small original is repeatedly copied, magnetic toner particles present at a site of the toner holding member where no development is carried out (e.g. the site is outside of the portion corresponding to the area of the small original) simply rotate together with the toner holding member to which said toner particles attach, and new magnetic toner particles are hardly supplied to said magnetic toner particles.

For example, when, after producing a great many sheets of copy of a A-4 size original, a B-4 size original having a wider area than a A-4 size original is copies, a portion of the resulting image developed with toner particles existing at a portion which is not used for developing the A-4 size image has a lower image density than the other portion of thCe resulting image developed with toner particles existing at a portion which is used for developing the A-4 size image. The reason why such lower density is obtained is not yet clear, but it is considered that in general, one-component magnetic toner particles hardly move about and the one-component magnetic toner particles attached to a portion of a toner holding member which is not used for development are repeatedly rotated without being replaced by new toner particles, and this appears to be the cause.

SUMMARY OF THE INVENTION

An object of the present invention is to provide a developing powder free from the above mentioned drawbacks and having excellent physical and chemical characteristics.

Another object of the present invention is to provide a one-component magnetic developing powder overcoming the drawback inherent to one-component development.

A further object of the present invention is to provide a developing powder which is of high impact strength, no coagulation, high flowability and high durability.

Still another object of the present invention is to provide a developing powder which does not so much attach to a developing powder holding member, the surface of a photosensitive member, a cleaning blade and the like and does not damage them so much.

A still further object of the present invention is to provide a developing powder capable of producing always stable and sharp and clear images free from fog.

According to the present invention, there is provided a developing powder which comprises a binder containing 50% by weight or more of a polymer having a gel content of 10% or less and prepared from a vinyl type monomer and a crosslinking agent monomer contained in an amount of 0.01–10% by weight based on the total weight of the monomers, and 0.1–5% by weight of an olefin homopolymer or copolymer having a melt viscosity at 140° C. of $10–10^6$ cps.

Accroding to another aspcet of the present invention, there is provided a developing process which comprises transferring a triboelectrically charged developing powder to an electrostatic image bearing member, the electrostatic image bearing member being arranged facing to and in spaced relation to a developer carrying member, the developer carrying member being provided with a layer of the developing powder on the surface and the thickness of the layer being smaller than the space distance between the surface of the developer carrying member and the surface of the electrostatic image bearing member, and the developing powder comprising a binder containing 50% by weight or more of a polymer having a gel content of 10% or less and prepared from a vinyl type monomer and a crosslinking agent monomer contained in an amount of 0.01–10% by weight based on the total weight of the monomers, and 0.1–5% by weight of an olefin homopolymer or copolymer having a melt viscosity at 140° C. of $10–10^6$ cps.

DESCRIPTION OF THE PREFERRED EMBODIMENTS

Figure 1:
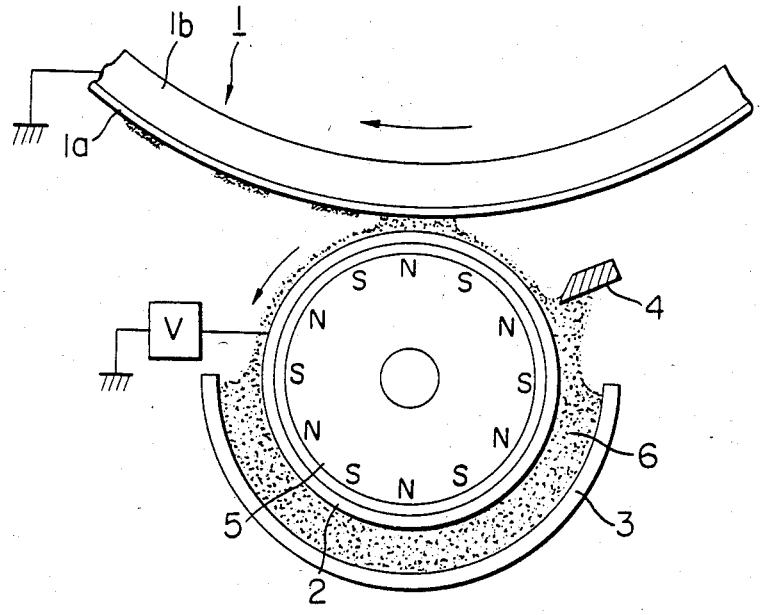
FIG. 1 shows schematically a cross sectional view of a developing vessel where a magnetic developer of the present invention may be employed.

As mentioned above, brittleness of a toner is largely concerned with the life of a developer. If a toner is brittle, the toner can be easily crashed by a mechanical force, and such brittleness is preferable from the viewpoint of productivity of toner, but such brittle toner is easily crashed by a load applied thereto in the developing device resulting in a finely divided toner. Thus the developing sleeve is dirtied, and charge control of the toner particle itself becomes incomplete resulting in formation of fog.

On the contrary, if a toner is too hard, the mechanical pulverization of the toner is not possible so that it is difficult to produce practically the toner.

In view of the foregoing, heretofore, polystyrene or styrene-butyl methacrylate copolymers of an appropriate hardness and a relatively low molecular weight (several thousands) have been used as a preferable binder resin for toners.

Improvement in reliability of copying machines has been recently demanded strongly.

Copying machine manufactures are now trying to develop copying machines of a long life and a "maintenance-free" type. Under such situations, various characteristics of toners have been reviewed and it has been found that the above mentioned polystyrene or styrene-butyl methacrylate copolymer of a relatively low molecular weight does not have a sufficient hardness so that a material having a higher hardness is required.

Taking the above drawbacks into consideration, the present inventors have researched with another intention of solving the above mentioned intrinsic disadvantage of a one-component developing system. As the result, the present invention has been completed.

The "gel content" according to the present invention is a degree of crosslinking represented by the amount of the polymer portion which is insoluble in a solvent as a result of crosslinking. The gel content is defined as shown below. 0.5–1g. of polymer particles is placed in a vessel made of a 400 mesh wire ($W_1$ g) and accurately weighed ($W_2$ g). Both the polymer and the vessel are soaked in toluene at 20° C. and allowed to stand for 48 hours. Then they are taken out of the toluene, dried and weighed ($W_3$ g).

$$\text{Gel content} = \frac{W_3 - W_1}{W_2 - W_1} \times 100\%$$

The vinyl type monomer used in the present invention includes styrene and substituted styrene such as styrene, α-methylstyrene, p-chlorostyrene and the like; unsubstituted or substituted monocarboxylic acids having a double bond such as acrylic acid, methyl acrylate, ethyl acrylate, butyl acrylate, dodecyl acrylate, octyl acrylate, phenyl acrylate, methacrylic acid, methyl methacrylate, ethyl methacrylate, butyl methacrylate, octyl methacrylate, acrylonitril, methacrylonitrile, acrylamide and the like; unsubstituted or substituted dicarboxylic acids having a double bond such as maleic acid, butyl maleate, methyl maleate, dimethyl maleate and the like; vinyl esters such as vinyl chloride, vinyl acetate vinyl benzoate and the like; olefins such as ethylene, propylene butylene and the like; vinyl ketones such as vinyl methyl ketone vinyl hexyl ketone and the like; and vinyl ethers such as vinyl methyl ether, vinyl ethyl ether, vinyl isobutyl ether, and the like.

According to the present invention, one or more of vinyl type monomers may be used.

Combinations of at least one of styrene and substituted styrene and at least one of acrylic acid esters and methacrylic acid esters are particularly preferable.

According to the present invention, representative crosslinking agent monomers are compounds having two or more double bonds capable of polymerization, for example, aromatic divinyl compounds such as divinyl benzene, divinyl naphthalene, and the like, carboxylic acid esters having two double bonds such as ethylene glycol diacrylate, ethylene glycol dimethacrylate, 1,3-butane diol dimethacrylate and the like, divinyl compounds such as divinyl aniline, divinyl ether, divinyl sulfide, divinyl sulfone and the like, and compounds having three or more vinyl groups.

As the crosslinking agent monomer, one or more of the above mentioned compounds may be used.

As the molecular weight controlling agent used for controlling appropriately the molecular weight of the crosslinked polymer according to the present invention, there may be used known molecular weight controlling agents, for example, mercaptans such as lauryl mercaptan, phenyl mercaptan, butyl mercaptan, dodecyl mercaptan and the like, and halogenateq carbons such as carbon tetrachloride, carbon tetrabromide and the like.

The molecular weight controlling agent is preferably used in an amount of less than 20% by weight based on the monomers.

Preferable weight average molecular weight of the crosslinked polymer controlled as mentioned above ranges from 5,000 to 1,000,000. Where the molecular weight is lower than 5,000, the resulting toner is too brittle while where the molecular weight exceeds 1,000,000, the resulting toner is so hard that production of said toner is not easy.

The crosslinked polymers according to the present invention may be produced by a known preparation method such as emulsion polymerization, suspension polymerization, solution polymerization, bulk polymerization and the like. Solution polymerization is preferable.

Toners prepared from the above-mentioned crosslinked polymers, charge controlling agents, and if desired, magnetic materials, and other necessary ingredients are so strong against loads applied in a developing vessel that the toners are not crashed in a duration test and therefore, are not deteriorated.

However, the toner particles are so hard that they damage and wear various materials and members used for copying machines such as the surface of photosensitive members, cleaning members, the surface of developing sleeves and the like. Therefore, durability of toners is improved, but the life of the copying mechine system can not lengthen.

In addition, crosslinked polymers generally suffer from a drawback that pigments can not be sufficiently and uniformly dispersed therein, and therefore, the toners comprising crosslinked polymers are disadvantageously of low durability upon repeated copying.

In order to solve such drawbacks, the present inventors have researched and found that addition of a small amount (0.1–5% by weight based on the total amount of the binder) of a homopolymer or copolymer of olefins having a melt viscosity at 140° C. of $10–10^6$ cps., preferably $10^2–10^5$ cps. can eliminate the drawbacks. In the case of olefin copolymers, the copolymers usually contain at least 50% by weight of the olefin monomer, preferably at least 80% by weight thereof, and more particularly at least 95% by weight thereof.

At the range of a melt viscosity at 140° C. of from 10 to $10^6$ cps., the olefin polymers are relatively compatible with the crosslinked polymers, and the developing characteristics of the resulting toner are very good.

Further, the content of the olefin polymers ranges from 0.1 to 5% by weight based on the total amount of the binder since at the content of less than 0.1% by weight the above mentioned effect is hardly observed while, at the content of higher than 5% by weight, non-coagulation property of the toner is poor.

Further, according to the present invention, the drawback that pigments can not be sufficiently dispersed in the crosslinked polymer can be solved by addition of said small amount of the olefin homopolymer or copolymer. As a result, developing characteristics of the developer is improved to a great extent.

As the olefin homopolymer and olefin copolymer, there may be mentioned polyethylene, polypropylene, ethylene-propylene copolymer, ethylene-vinyl acetate copolymer, ethylene-ethyl acrylate copolymer, ionomers having a polyethylene skeleton and the like.

In the case of copolymers, copolymers preferably contain 50 mole % or more of an olefin monomer, more preferably 60 mole % or more. Preferable polymer is polyethylene, and in particular, a high density polyethylene is preferable.

The melt viscosity is measured by Brookfield method. According to the present invention, the measurement is conducted by attaching a small amount sample adapter to the B-type visco-meter.

As the magnetic powder contained in the developing powders according to the present invention, there may be used a material capable of being magnetized in a magnetic field such as magnetite, hematite, ferrite and the like having an average particle size of about 0.1–2$\mu$. The amount of the magnetic powder is preferably 15–70% by weight, more preferably 25–50% by weight based on the weight of the toner.

In addition to the above mentioned materials, the developing powder of the present invention may contain some other known binder materials, for example, the following compounds:

Homopolymers of styrene and substituted styrene such as polystyrene, poly-p-chlorostyrene, polyvinyltoluene and the like styrene copolymers such as styrene-p-chlorostyrene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl o-chloromethacrylate, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer and the like, silicon resins, polyvinyl chloride, polyvinyl acetate polyester, polyurethane, polyamide, epoxy resins, polyvinyl butyral, rosin, modified rosin, terpene resins, phenolic resins, aliphatic or alicyclic hydrocarbon resins, aromatic petroleum resins, chlorinated paraffins, paraffin waxes and the like.

To the toner used in the present invention there may be added various materials for the purpose of colorizing, chargeability control and the like. For example, the materials may be carbon black, iron black, graphite, nigrosine, metal complexes of monoazo dyes (e.g. Japanese Patent Publication Nos. 20153/1966, 17955/1968, 27596/1968, 6397/1969, and 26478/1970), ultramarine, Phthalocyanine Blue, Hanza Yellow, Benzidine Yellow, quinacridone, lake pigments and the like.

Developing methods where the developing powder of the present invention is preferably used are those utilizing magnetism without carrier particles. Particularly preferable developing methods are the methods in Japanese Pat. Application Laid-open Nos. 42141/1979 and 18656/1980, a method where a conductive magnetic toner is used disclosed in U.S. Pat. No. 3,909,258, and a method where a magnetic toner of high electric resistance is utilized disclosed in Japanese Patent Application Laid-open No. 31136/1978. For transferring the developed images to an image receiving member, there may be used electrostatic transferring methods such as corona transferring methods, bias transferring methods conductive roller methods and the like, and transferring methods where magnetic fields are used.

Removing toners remaining on a photosensitive layer or insulating layer may be carried out by a blade cleaning method, fur brush cleaning method, magnetic brush cleaning method or the like.

Toner images transferred to an image receiving member may be fixed by heat fixing, solvent fixing, flash fixing, laminate fixing or the like.

Preparation Examples I–VI for illustrating preparation of crosslinked polymers are shown below.

In the Preparation Examples and the Examples below, parts are by weight unless otherwise specified.

I. 50 parts of xylene was placed in a three-necked flask, and 80 parts of styrene, 15 parts of butyl acrylate, 5 parts of butyl maleate, 0.8 part of divinyl benzene and 0.3 part of benzoyl peroxide were dropwise added to the flask by using a dropping funnel under reflux over 3 hours. Then a solution of 0.3 part of benzoyl peroxide in xylene was dropwise added, and reflux was continued for 3 hours. Then the reaction mixture was cooled and xylene was removed to recover styrene-butyl acrylate-butyl maleate-divinyl benzene copolymer.

The gel content was 0%.

II. The procedure of I. above was repeated except that 70 parts of styrene, 30 parts of butyl methacrylate, and 0.6 part of divinyl benzene were used in place of the monomers in I. The resulting gel content was 0%.

III. The procedure of I. above was repeated except that 65 parts of styrene, 10 parts of methyl methacrylate, 25 parts of butyl acrylate and 1 part of divinyl-benzene were used in place of the monomers in I.

The gel content was 0%.

IV. The procedure of I. above was repeated except that 70 parts of styrene, 25 parts of butyl acrylate, 5 parts of butyl maleate, and 1.5 parts of divinyl benzene were used in place of the monomers in I.

The gel content was 3%.

V. The procedure of I. above was repeated except that 60 parts of styrene, 20 parts of butyl acrylate, 20 parts of butyl methacrylate, and 0.6 part of 1, 3-butanediol dimetha-crylate were used in place of the monomers in I.

The gel content was 0%.

VI. 70 parts of styrene, 25 parts of butyl methacrylate, 5 parts of acrylonitrile, 2 parts of azobisisobutyronitrile, 1 part of divinyl benzene and 0.5 part of lauryl mercaptan were polymerized at 60° C. for 10 hours by suspension polymerization and then at 80° C. for further 3 hours. After completion of the polymerization, the suspension was filtered and washed, and dried.

The gel content of the resulting polymer was 5%.

The present invention is further explained in detail by the following working examples.

EXAMPLE 1

100 parts of styrene-butyl acrylate-butyl maleatedivinyl benzene copolymer, 2 parts of polyethylene having a melt viscosity at 140° C. of 720 c.p. and a degree of crystallinity of 70%, 60 parts of magnetic powder of $Fe_3O_4$ having an average particle size of 0.3 u, and 2 parts of a metal-containing dye (tradename, "Zapon Fast Black B", supplied by BASF) were ground and mixed by a ball mill and melted and kneaded by a roll mill. After cooling, the mixture was crashed by a hammer mill followed by pulverizing by a supersonic jet pulverizer. The resulting powders were classified by air elutriation and particles of 5–35 $\mu$ in size were collected for using as a developing powder. To 100 parts of the developing powder was added 0.3 part of a hydrophobic colloidal silica powder and mixed for using as a developer.

Referring to FIG. 1, the resulting developer was used for image formation by the developing device.

A photosensitive drum 1 has a conductive metal drum 1*b* and a photosensitive member for electrophotography 1*a* overlying the periphery of the drum 1*b*. The drum 1*b* is grounded. Drum 1 rotates in the direction of the arrow sign at a constant speed.

A cylindrical sleeve 2 for carrying and transferring a developer simultaneously with imparting electric charge to the developing powder rotates in the direction of the arrow sign at the same peripheral speed as the drum. The developer is being electrically charged and transferred to the developing portion as cylinder 2 rotates.

A vessel 3 is a vessel for retaining an insulating one-component developer comprising insulating magnetic toner 6, and is so arranged that the developer contacts the surface of cylinder 2.

An iron blade 4 is placed with a small space from the cylinder 2. The blade 4 controls the amount of the developer moving on the cylinder 2 towards the developing portion. A multipolar magnet roll (12 poles) 5 is fixed in FIG. 1.

A photosensitive drum consisting of an insulating layer Ccomposed of three layers, i.e. a polyester resin, a photosensitive layer composed of CdS and an acryl resin, and a conductive substrate was subjected to corona discharge of +6 KV at the surface of the insulating layer to be uniformly charged, A.C. corona discharge of 7 KV simultaneously with imagewise exposure, and finally a blanket exposure to produce electric latent images on the surface of the photosensitive member.

A developing device of a sleeve-rotating magnet-fixed type (the sleeve peripheral speed being the same as the drum peripheral speed, but rotating in the opposite direction) which has a sleeve diameter of 50 mm, a sleeve surface magnetic flux density of 700 gauss and the space between the blade and the surface of the sleeve of 0.25 mm was disposed at a space between the photosensitive drum surface and the sleeve surface of 0.25 mm, and an A.C. bias of 200 Hz and 600 V was applied to the sleeve surface and the latent images were developed with the above mentioned developer followed by applying a D.C. corona of +7 KV from the rear side of a receiving paper to transfer the developer toner images to obtain the reproduced images. The developer remaining on the photosensitive drum was removed by using a polyurethane blade and the fixation was effected by using a commercially available copying paper for ordinary paper (tradename, NP-5000, manufactured by Canon K.K.). The resulting images were clear, free from fog, and of high resolution.

After producing 10,000 sheets of copy of B-5 size, copying of an A-4 size paper was conducted. There was not a substantial difference between the image corresponding to the portions which were not used for copying the B-5 size original and the image corresponding to the portions used for copying the B-5 size original, and there were obtained good images. Further, the copying was continued until 100,000 sheets of copy were produced. The resulting images were good and the cleaning blade, photosensitive drum, developing sleeve and the like were hardly damaged, and any fusion bonding of the toner was not observed.

COMPARISON EXAMPLE 1

A styrene-butyl acrylate-butyl maleate-divinyl benzene copolymer was obtained by bulk polymerization. The gel content was 71%.

The procedure of Example 1 was repeated except that 100 parts of the copolymer as obtained above was used in place of the copolymer of Preparation Example I.

After copying 10,000 sheets of a B-5 size paper, copying of an A-4 size original was effected. The resulting image corresponding to the portion which was not used for copying a B-5 size paper was remarkably lower and poorer in the density than the resulting image corresponding to the portion used for copying a B-5 size paper.

COMPARISON EXAMPLE 2

The procedure of Example 1 was repeated except that a copolymer prepared by following the procedure of Preparation Example I except that divinyl benzene was not used was employed in place of the copolymer of Example 1.

In the running test, the image density became low after about 30,000 sheets had been copied, and the image became poorer.

| Number of Copied sheets | Example 1 | | Comparison Example 1 | | Comparison Example 2 | |
|---|---|---|---|---|---|---|
| (ten thousand) | Image density | Fog density | Image density | Fog density | Image density | Fog density |
| Beginning | 1.25 | 0.00 | 1.20 | 0.01 | 1.31 | 0.01 |
| 1 | 1.23 | 0.01 | 1.15 | 0.02 | 1.25 | 0.01 |
| | (1.18) | | (0.71) | | (1.09) | |
| 2 | 1.15 | 0.00 | — | — | 1.13 | 0.02 |
| 3 | 1.21 | 0.02 | — | — | 1.07 | 0.02 |
| 4 | 1.24 | 0.01 | — | — | 0.82 | 0.03 |
| 5 | 1.10 | 0.01 | — | — | 0.50 | 0.04 |
| 6 | 1.08 | 0.01 | — | — | Stop | |
| 7 | 1.15 | 0.02 | — | — | | |
| 8 | 1.17 | 0.01 | — | — | | |
| 9 | 1.09 | 0.01 | — | — | | |
| 10 | 1.12 | 0.01 | — | — | | |

The value in the parentheses is the image density at a portion of the A-4 size copy corresponding to the portion which was not used for copying a B-5 size paper.

EXAMPLE 2

The procedure of Example 1 was repeated except that 100 parts of the copolymer of Preparation Example II was used in place of the copolymer in Example 1, and there was obtain a good result.

EXAMPLE 3

The procedure of Example 1 was repeated except that 100 parts of the copolymer of Preparation Example II was used the toner was produced by using 100 parts of the polymer of Preparation Example III, 3 parts of polyethylene having a melt viscosity at 140° C. of about 30,000 c.p. and a degree of crystallinity of 75%, 60 parts of magnetic powder of $Fe_3O_4$ having an average particle size of 0.3 μ, and 2 parts of a metal-containing dye (tradename, "Zapon Fast Black B", supplied by BASF). There were produced clear images free from fog. After copying 10,000 sheets of a B-5 size paper, copying an A-4 size original was effected. There was not a substantial difference between the image corresponding to the portion used for copying a B-5 size original and that not used therefor.

EXAMPLE 4

The procedure of Example 1 was repeated except that the toner was produced by using 100 parts of the polymer of Preparation Example IV, 3 parts of polyethylene having a melt viscosity at 140° C. of 720 c.p. and a degree of crystallinity of 70%, 70 parts of magnetic powder of a ferrite powder having an average particle size of 0.2 μ, 5 parts of carbon black and 2 parts of a metal-containing dye. The result was good.

EXAMPLE 5

The procedure of Example 1 was repeated except that the copolymer of Preparation Example V was used. A good result was obtained.

EXAMPLE 6

The procedure of Example 1 was repeated except that the toner was produced by using 100 parts of the copolymer of Preparation Example IV, 4 parts of polyethylene having a melt viscosity at 140° C. of 4,300 c.p., 80 parts of a magnetic powder of $Fe_3O_4$ having an average particle size of 0.3 μ, and 2 parts of a metal-containing dye. There were obtained clear images free from fog.

After producing 10,000 sheets of copy of a B-5 size original, copying of an A-4 size original was effected. There was some difference between the images developed with the toner particles present at the sites used for copying the B-5 size original and the images developed with those at the sites not used therefor.

EXAMPLE 7

The procedure of Example 1 was repeated except that the toner was produced by using 80 parts of the copolymer of Preparation Example I, 20 parts of a non-crosslinked styrene-butyl acrylate-butyl maleate copolymer, 60 parts of a magnetic powder of $Fe_3O_4$ having an average particle size of 0.3 μ, 1 part of polypropylene having a melt viscosity at 140° C. of about 400 c.p. and 2 parts of a metal-containing dye. Though the durability of toner was somewhat low, there was obtained a good result.

EXAMPLE 8

The procedure of Example 1 was repeated except that one part of the polyethylene was used in place of two parts of the polyethylene, and there was obtained a good result.

EXAMPLE 9

A toner was produced by repeating the procedure of Exampel 1 except that there were used 100 parts of the copolymer of Preparation Example 1, 3 parts of polyethylene having a melt viscosity at 140° C. of 720 c.p. and a degree of crystallinity of 70%, 100 parts of a magnetic powder of a ferrite powder having an average particle size of 0.2 μ, and 5 parts of carbon black.

To 100 parts of the resulting toner was added 1.4 parts of carbon black to produce a developer. Latent images were formed by the procedure of Example 1 and developed with the developer under the conditions, i.e. the space between the sleeve and the blade being 0.6 mm, the space between the sleeve and the drum being 0.4 mm, and the sleeve together with the magnet and the drum moving in the same direction. The resulting images were clear and free from fog.

What we claim is:

1. An electrophotographic process comprising developing a latent image on a latent image supporting member with a toner, transferring the toner image developed, and removing the toner remaining on said image supporting member, characterized in that said toner is a developing powder which comprises a binder containing 0.1–5% by weight of an olefin homopolymer or copolymer having a melt viscosity at 140° C. of 10–$10^6$ cps. and containing 50% by weight or more of a crosslinked polymer, said crosslinked polymer in its entirety having a gel content of 10% or less and being prepared from a vinyl type monomer and a crosslinking agent monomer contained in an amount of 0.01–10% by weight based on the total weight of the monomers.

* * * * *

UNITED STATES PATENT AND TRADEMARK OFFICE

CERTIFICATE OF CORRECTION

PATENT NO. : 4,565,766

DATED : January 21, 1986 Page 1 of 2

INVENTOR(S) : YASUO MITSUHASHI, ET AL.

It is certified that error appears in the above-identified patent and that said Letters Patent is hereby corrected as shown below:

Column 1, line 4, "319.083" should be --319,083,--.
Column 1, line 53, "collide each other" should be --collide with each other--.
Column 1, line 63, "phonomena" should be --phenomena--.
Column 2, line 35, "is copies," should be --is copied,--.
Column 2, line 40, "thCe resulting" should be --the resulting--.
Column 3, line 13, "Accroding to another aspcet" should be --According to another aspect--.
Column 3, line 34, "cross sectional" should be --cross-sectional--.
Column 3, line 61, "manufactures" should be --manufacturers--.
Column 4, lines 33-34, "vinyl acetate vinyl" should be --vinyl acetate, vinyl--.
Column 4, line 35, "propylene butylene" should be --propylene, butylene--.
Column 4, line 36, "ketone vinyl" should be --ketone, vinyl--.
Column 4, line 64, "halogenateq" should be --halogenated--.
Column 5, line 25, "mechine" should be --machine--.
Column 6, line 4, "visco-meter" should be --viscometer--.
Column 6, line 19, "like styrene" should be --like, styrene--.
Column 6, line 27, "o-chloromethacrylate," should be --a-chloromethacrylate,--.
Column 6, line 33, "acetate polyester" should be --acetate, polyester--.
Column 6, lines 59-60, "methods conductive" should be --methods, conductive--.
Column 7, line 33, "dimetha-crylate" should be --dimethacrylate--.
Column 7, line 48, "maleatedivi-nyl" should be --maleate-divinyl--.
Column 7, line 52, "0.3u," should be --0.3-μ--.

UNITED STATES PATENT AND TRADEMARK OFFICE

CERTIFICATE OF CORRECTION

PATENT NO. : 4,565,766

DATED : January 21, 1986

INVENTOR(S) : YASUO MITSUHASHI, ET AL.

It is certified that error appears in the above-identified patent and that said Letters Patent is hereby corrected as shown below:

Column 7, line 56, "crashed" should be --crushed--.
Column 8, line 20, "layer Ccomposed" should be --layer composed--.
Column 9, line 44, "obtain" should be --obtained--.
Column 9, lines 48-49, delete "100 parts of the copolymer of Preparation Example II was used"
Column 10, line 47, "Exampel" should be --Example--.

Signed and Sealed this

Sixth Day of January, 1987

*Attest:*

DONALD J. QUIGG

*Attesting Officer*

*Commissioner of Patents and Trademarks*